US011378084B2

(12) United States Patent
Nohmi

(10) Patent No.: US 11,378,084 B2
(45) Date of Patent: Jul. 5, 2022

(54) APPARATUS AND METHOD FOR ALLEVIATING AND PREVENTING CAVITATION SURGE OF WATER SUPPLY CONDUIT SYSTEM

(71) Applicant: EBARA CORPORATION, Tokyo (JP)

(72) Inventor: Motohiko Nohmi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/690,627

(22) Filed: Nov. 21, 2019

(65) Prior Publication Data

US 2020/0088203 A1 Mar. 19, 2020

Related U.S. Application Data

(62) Division of application No. 14/917,512, filed as application No. PCT/JP2014/074098 on Sep. 11, 2014, now abandoned.

(30) Foreign Application Priority Data

Sep. 12, 2013 (JP) ..... 2013-189353

(51) Int. Cl.
*F04D 15/00* (2006.01)
*F04D 29/66* (2006.01)
(Continued)

(52) U.S. Cl.
CPC ..... *F04D 15/0083* (2013.01); *F04D 1/00* (2013.01); *F04D 29/22* (2013.01);
(Continued)

(58) Field of Classification Search
CPC ..... F04D 29/669; F04D 29/668; F04D 29/22; F04D 29/4293; F04D 15/0083; F04D 1/00
See application file for complete search history.

(56) References Cited

U.S. PATENT DOCUMENTS 1,692,375 A * 11/1928 Josephs, Jr. ..... G05D 16/10 417/46
2,470,565 A * 5/1949 Loss ..... F04D 27/0207 415/27
(Continued)

FOREIGN PATENT DOCUMENTS

JP 5181001 A 7/1976
JP 54119103 A 9/1979
(Continued)

OTHER PUBLICATIONS

International Search Report dated Nov. 18, 2014 for PCT/JP2014/074098.
(Continued)

*Primary Examiner* — David E Sosnowski
*Assistant Examiner* — Wayne A Lambert
(74) *Attorney, Agent, or Firm* — Pearne & Gordon LLP

(57) ABSTRACT

A turbo pump acts on a liquid, and an apparatus and a method suppresses or alleviates a cavitation surge which is a unique phenomenon occurring in a turbo pump for a liquid. A method of operating a turbo pump while suppressing cavitation, includes: measuring a flow rate upstream of the turbo pump and a flow rate downstream of the turbo pump for delivering a liquid and comparing the flow rates with each other; if the upstream flow rate is lower than the downstream flow rate, reducing a pressure in a pump suction section to increase an upstream flow velocity while reducing a pressure in a pump discharge section to lower a downstream flow velocity; and if the downstream flow rate is lower than the upstream flow rate, increasing the pressure in the pump discharge section to increase the downstream flow velocity while increasing the pressure in the pump suction section.

4 Claims, 9 Drawing Sheets

(51) Int. Cl.
*F04D 1/00* (2006.01)
*F04D 29/22* (2006.01)
*F04D 29/42* (2006.01)

(52) U.S. Cl.
CPC ..... *F04D 29/4293* (2013.01); *F04D 29/668* (2013.01); *F04D 29/669* (2013.01)

(56) References Cited

U.S. PATENT DOCUMENTS 2,945,566 A * 7/1960 Eames ..... F16D 65/853 188/264 F
3,238,534 A * 3/1966 Hartland ..... F03B 3/103 415/910
3,267,669 A * 8/1966 Tissier ..... F02C 7/04 73/112.06
3,362,624 A * 1/1968 Endress ..... F04D 27/0215 415/1
3,741,677 A 6/1973 Silvern et al.
3,807,444 A 4/1974 Fortune
3,901,620 A 8/1975 Boyce
3,976,390 A * 8/1976 Silvern ..... F04D 27/0215 415/58.1
4,036,561 A * 7/1977 Harand ..... F04D 15/0077 976/DIG. 200
4,228,753 A 10/1980 Davis et al.
4,363,596 A * 12/1982 Watson ..... F01D 17/143 415/1
4,691,739 A 9/1987 Gooden
4,964,783 A 10/1990 Haverkamp
4,990,794 A 2/1991 Ferrari et al.
5,154,570 A 10/1992 Yoshikawa et al.
5,618,160 A 4/1997 Harada et al.
5,683,223 A * 11/1997 Harada ..... F04D 27/001 415/17
5,947,680 A * 9/1999 Harada ..... F04D 27/0261 415/17
6,517,309 B1 2/2003 Zaher
6,994,518 B2 * 2/2006 Simon ..... F04D 27/0246 415/185
7,056,103 B2 * 6/2006 LaRue ..... F01D 25/125 415/4.3
7,094,016 B1 * 8/2006 Zaher ..... F04D 31/00 415/1
7,326,027 B1 * 2/2008 Skoch ..... F04D 27/0207 415/150
8,814,499 B2 * 8/2014 Kim ..... F04D 29/0516 415/58.4
9,850,913 B2 12/2017 An et al.
10,167,877 B2 1/2019 Ibaraki et al.
2001/0032948 A1 10/2001 Austin
2004/0096316 A1 5/2004 Simon et al.
2013/0037119 A1 2/2013 Doughty

FOREIGN PATENT DOCUMENTS

JP 55142998 A 11/1980
JP 5751971 A 3/1982
JP S57-168100 A 10/1982
JP S59-18283 A 1/1984
JP S59-184399 U 12/1984
JP 608494 A 1/1985
JP H04-314978 A 11/1992
JP 6178600 A 8/1996
JP H11-159416 A 6/1999

OTHER PUBLICATIONS

Japanese Office Action issued in Japanese Patent Application No. 2015-536625 dated Jan. 30, 2019.

* cited by examiner

APPARATUS AND METHOD FOR ALLEVIATING AND PREVENTING CAVITATION SURGE OF WATER SUPPLY CONDUIT SYSTEM

CROSS-REFERENCE TO RELATED APPLICATIONS

This is a division of U.S. patent application Ser. No. 14/917,512, filed Mar. 8, 2016, which is the National Stage of PCT/JP2014/074098, filed Sep. 11, 2014 which claims priority to Japanese Patent Application 2013-189353, filed Sep. 12, 2013, the entireties of each of which are incorporated herein by reference.

TECHNICAL FIELD

The present invention relates to a turbo pump that acts on a liquid, and relates to an apparatus and a method for suppressing or alleviating a cavitation surge which is a unique phenomenon occurring in a turbo pump for a liquid.

BACKGROUND ART

In a turbo pump such as water pump, a so-called cavitation unstable phenomenon can occur with a cavitation development, thus causing a pump shaft vibration, a stress fluctuation of an impeller, and noise. The cavitation unstable phenomenon includes a cavitation surge, which is a phenomenon of significant pulsations of flow rate and pressure in a pipe system at cycles lower than a rotating speed of an impeller.

The occurrence of the cavitation surge (or cavitation surging) causes not only a vibration of a fluid side, but also a vibration and noise in machinery element, such as conduit system and a pump which constitute a structure side. If the cavitation surge occurs vigorously, the conduit system may be broken, or the noise may be increased to an unpleasant level.

Conventional approaches for preventing the cavitation are to improve designs of an impeller, a diffuser, a casing, or other component which are structural elements in a pump, or to return a part of fluid at a discharge side of the pump back into a suction side. Such improved designs that can reduce the cavitation have been made in an attempt to avoid this phenomenon.

However, the above-described approaches may adversely affect efficiency. Further, since a pump is operated over a wide range with various flow rates, it is difficult to avoid the cavitation surging over the operation range in its entirety only by the design improvement of a part of the pump itself, such as the impeller or the casing.

On the other hand, there has been an attempt to alleviate this problem by providing an additional equipment or device outside the pump. For example, a surge tank, which is installed at the suction side or discharge side of the pump, can alleviate the pulsation of the cavitation surge to some degree.

However, when the cavitation surge occurs, the flow rate at an outlet (i.e., a discharge outlet) and at an inlet of the pump fluctuates in different manners. Accordingly, the surge tank, which is disposed upstream of the pump inlet, cannot directly alleviate the pulsation occurring downstream of the pump outlet. Although there is a study showing a fact that a surge tank, provided downstream of the pump outlet, is effective, no attention has been focused on both the pump upstream side and the pump downstream side when the cavitation surge occurs, and no measures have taken for the entirety of the pump system.

CITATION LIST

Patent Literature

Patent document 1: Japanese laid-open patent publication No. 61-178600

SUMMARY OF INVENTION

Technical Problem

Thus, the inventor has diligently studied and, as a result, has conceived of the present invention by reconsidering this issue as a vibration phenomenon (fluctuation phenomenon of fluid element) of the entire system achieved by each element of the pump system. For example, a cyclical behavior of the cavitation surge can be regarded as "spring effect", a liquid delivered by the pump can be regarded as "inertia element", a pressure loss in a pipe or valve can be regarded as "resistance element", and the pump can be regarded as "negative resistance element".

The present invention provides an apparatus and a method for preventing a cavitation in an entirety of a pump system, in particular for suppressing or alleviating a cavitation surge.

Solution to Problem

In order to achieve the above object, according to one aspect of the present invention, there is provided a method of operating a turbo pump while suppressing a cavitation, comprising: measuring a flow rate upstream of the turbo pump and a flow rate downstream of the turbo pump for delivering a liquid and comparing the flow rates with each other; if the upstream flow rate is lower than the downstream flow rate, reducing a pressure in a pump suction section to increase an upstream flow velocity while reducing a pressure in a pump discharge section to lower a downstream flow velocity; and if the downstream flow rate is lower than the upstream flow rate, increasing the pressure in the pump discharge section to increase the downstream flow velocity while increasing the pressure in the pump suction section.

There is further provided an apparatus for suppressing a cavitation of a turbo pump, comprising: a turbo pump for delivering a liquid; a first damping device configured to repeatedly increase and reduce a pressure of the liquid upstream of the turbo pump so as to damp an amplitude of a cyclical pressure fluctuation of the liquid upstream of the turbo pump; and a second damping device configured to repeatedly increase and reduce a pressure of the liquid downstream of the turbo pump so as to damp a cycle of a cyclical pressure fluctuation of the liquid downstream of the turbo pump.

More specifically, the first damping device is configured to perform a pressure-reducing operation when the pressure of the upstream liquid increases and to perform a pressure-increasing operation when the pressure of the upstream liquid decreases, and the second damping device is configured to perform a pressure-reducing operation when the pressure of the downstream liquid increases and to perform a pressure-increasing operation when the pressure of the downstream liquid decreases.

More specifically, the apparatus for suppressing a cavitation of a turbo pump further comprises a controller configured to instruct the first damping device and the second damping device to perform operations based on information obtained from a detector provided upstream of the turbo pump and information obtained from a detector provided downstream of the turbo pump.

In another embodiment, each of the first damping device and the second damping device comprises a piston and a cylinder, and wherein the apparatus further comprises a device configured to stop motions of the piston of the first damping device and the piston of the second damping device, and further comprises a device configured to recover a balance position of at least one of the piston of the first damping device and the piston of the second damping device.

More specifically, each of the first damping device and the second damping device comprises a piston and a cylinder, and one of the piston of the first damping device and the piston of the second damping device is fitted into both the cylinder of the first damping device and the cylinder of the second damping device.

In still another embodiment, there is provided an apparatus for suppressing a cavitation of a turbo pump, comprising: a turbo pump for delivering a liquid; and a swell device coupled to a casing or a pipe disposed upstream of the turbo pump, the swell device being configured to push a volume of the liquid.

Specifically, there is provided a method of operating a turbo pump while suppressing a cavitation, comprising: measuring a flow rate or pressure upstream of the turbo pump for delivering a liquid; and when the flow rate or pressure is reduced, swelling a swell device arranged upstream of the turbo pump.

Advantageous Effects of Invention

According to the above, even if the pump is operated over a wide range with various flow rates, the cavitation surging can be effectively alleviated or suppressed over the entirety of the operation range of the pump.

Further, because the control is performed with the consideration of the pressures and the flows upstream and downstream of the pump at the time of the occurrence of the cavitation surging, the pulsation can be more effectively alleviated or suppressed in the entirety of the pump system including the pump upstream side, the pump inlet, the pump downstream side, and the pump outlet.

Moreover, the pressure-increasing-and-reducing devices, provided respectively at the upstream side and the downstream side, can independently increase and reduce the pressure in response to the cyclical fluctuation of the pressure which is compared with an arbitrarily-set reference pressure. Therefore, it is not necessary to return the flow rate of the liquid, pressurized by the pump, from the downstream side to the upstream side. As a result, a stable operation can be performed at a high efficiency without lowering a pump efficiency.

Further, the amplitude of the cavitation surge can be reduced, and the cavitation surge can be rapidly settled.

DESCRIPTION OF EMBODIMENTS

Upon describing specific embodiments of the present invention, a way of viewing a cavitation surge phenomenon will be described briefly with reference to FIG. 1 and FIG. 2.

Figure 1:
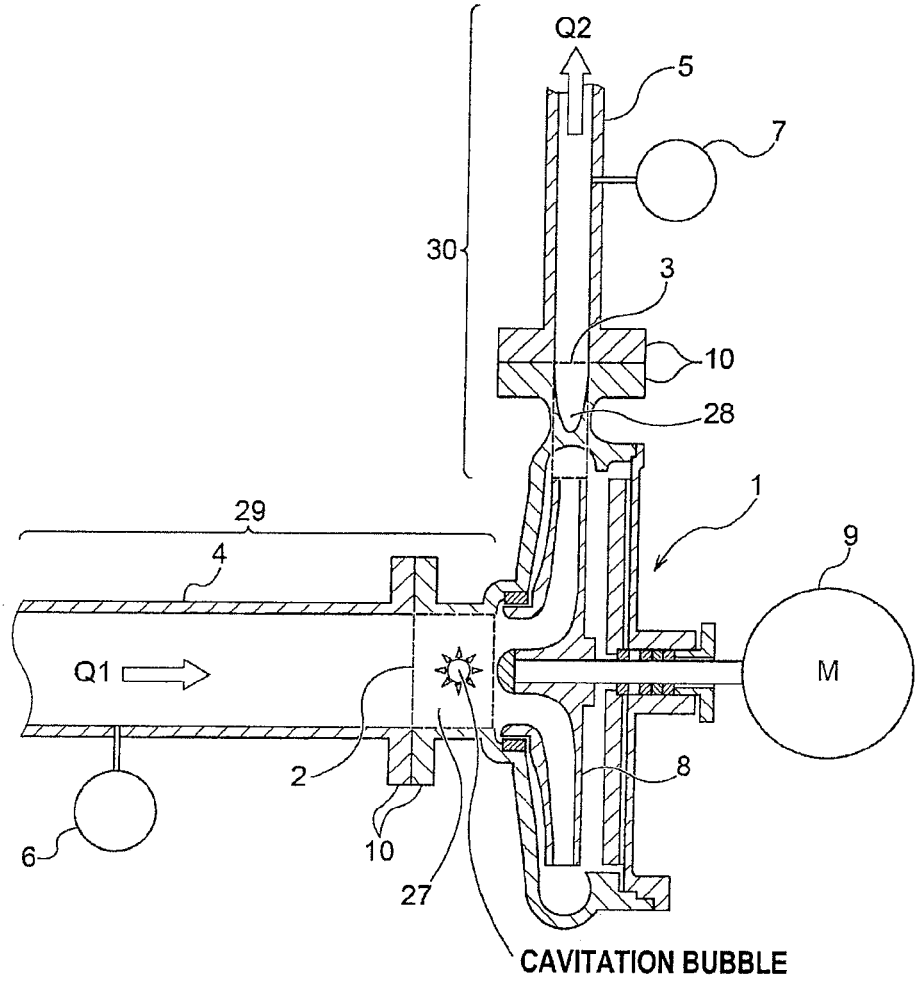
FIG. 1 is a schematic view of a pump system according to the present invention.

FIG. 1 is a schematic view of a turbo pump system. A pump 1, having an impeller 8 disposed in a casing, is a turbo pump. A rotating force of an exterior motor 8 is transmitted through a shaft to rotate the impeller 8. A pump-upstream pipe 4 is coupled to a pump inlet 2 by a flange 10. A space (indicated by dotted lines) located between the pump inlet 2 and the impeller 8 is a pump suction section 27. The pump suction section 27 and the pump-upstream pipe 4 constitute a pump upstream side 29. An upstream-side external device 6 is coupled to the pump-upstream pipe 4.

A pump-downstream pipe 5 is coupled to a pump outlet 3 by a flange 10. A space (indicated by dotted lines) located between the pump outlet 3 and the impeller 8 is a pump discharge section 28. The pump discharge section 28 and the pump-downstream pipe 5 constitute a pump downstream side 30. A downstream-side external device 7 is coupled to the pump-downstream pipe 5.

When the impeller 8 is rotated by the motor 9 with a liquid, such as water, filling a system, the liquid flows through the pump-upstream pipe 4 into the pump inlet 2 at a flow rate Q1, and is discharged by a pumping action of the impeller 8 from the pump outlet 3 into the pump-downstream pipe 5 at a flow rate Q2.

If no cavitation occurs, the following relation holds.

$$Q1=Q2$$

However, if the cavitation occurs and its volume increases, this relation does not hold. The cavitation can occur in the pump upstream side 29. Specifically, the cavitation can occur in the pump-upstream pipe 4, the pump inlet 2, and the pump suction section 27. A cavitation surge is caused by cyclically-repeated expansion and contraction of air bubbles of the cavitation. A volume Vc of the cavitation during the cavitation surge is considered to expand and contract due to a cyclical fluctuation of an inlet pressure P1 of the pump.

$$\kappa=-\partial Vc/\partial P1(t)$$

where κ represents a cavitation compliance. In an analogy that interprets the cavitation as the above-mentioned vibration phenomenon of a spring, κ corresponds to the reciprocal of an elastic constant of the spring.

On the other hand, when the volume Vc of the air bubbles of the cavitation increases, the flow rate Q1 and the flow rate Q2 differ from each other. The relation of these flow rates is expressed as $$dVc/dt=Q2-Q1$$

That is, the flow rates Q1, Q2 fluctuate cyclically with the fluctuation of the volume Vc.

Figure 2:
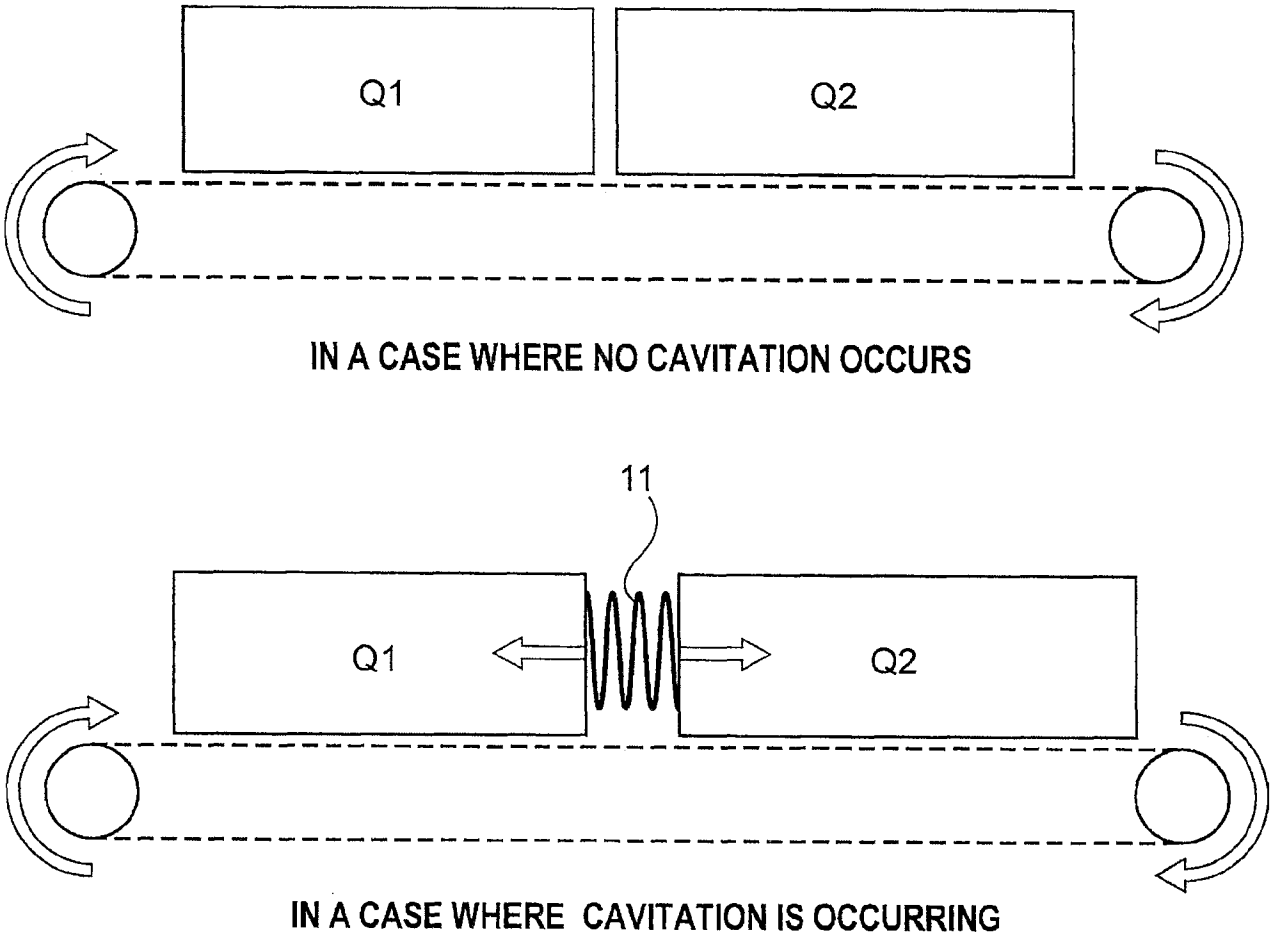
FIG. 2 is a schematic view of a phenomenon model according to the present invention.

FIG. 2 shows diagrams in which the above-discussed issues are explained simply as the vibration phenomenon. In the case where the cavitation does not occur, i.e., Q1=Q2, these Q1 and Q2 are placed side by side on a belt conveyor. As the belt conveyor moves from the right to the left, Q1 and Q2 also move. The belt conveyor serves as the pumping action. Although Q1 and Q2 slip slightly on the belt conveyor, Q1 and Q2 move in line as if they are one body.

On the other hand, in the case where the cavitation occurs, Q1 and Q2 are coupled to each other by a spring 11 which expands and contracts cyclically. It is assumed that Q1 and Q2 slip slightly on the belt conveyor. When the spring 11 fully expands, the spring 11 begins to contract so that the spring 11 pulls Q1 and Q2. According to the figure, Q1 is accelerated to the right, while Q2 is accelerated to the left. Further, when the spring 11 fully contracts, the spring 11, in turn, begins to expand so that Q1 is pushed to the left, while Q2 is pushed to the right. As a result, Q1 and Q2 behave in totally different manners. In order to settle such behaviors, it is necessary to apply a leftward force to Q1 and apply a rightward force to Q2 when Q1 is pulled to the right and Q2 is pulled to the left. Further, it is necessary to apply a rightward force to Q1 and apply a leftward force to Q2 when Q1 is pulled to the left and Q2 is pulled to the right.

Among actual systems, there is a system that cannot be explained by the analogy as shown in FIG. 2. Thus, characteristics in systems including such a situation will be classified and abstracted in more detail. For example, the cavitation is regarded as "spring element", the liquid is regarded as "inertia element", a pressure loss in a pipe or valve is regarded as "resistance element", the pump is regarded as "negative resistance element" or "power source". Under this theory, the cavitation surge can be regarded as a state in which the vibration continues with the supply of a power from "power source".

Therefore, it is possible in this system to stop the vibration by establishing an appropriate constant of "spring element", "inertia element", or "resistance element". Thus, the present invention offers a modification of a device that can change states of the cavitation and the liquid to thereby change the characteristics of a pump water-delivery system to stop or suppress (alleviate) the vibration. Since the pump upstream side and the pump downstream side are affected by the state of the cavitation in the pump suction section, it is preferable that a vibration damping action act on both the upstream side and the downstream side.

Figure 3:
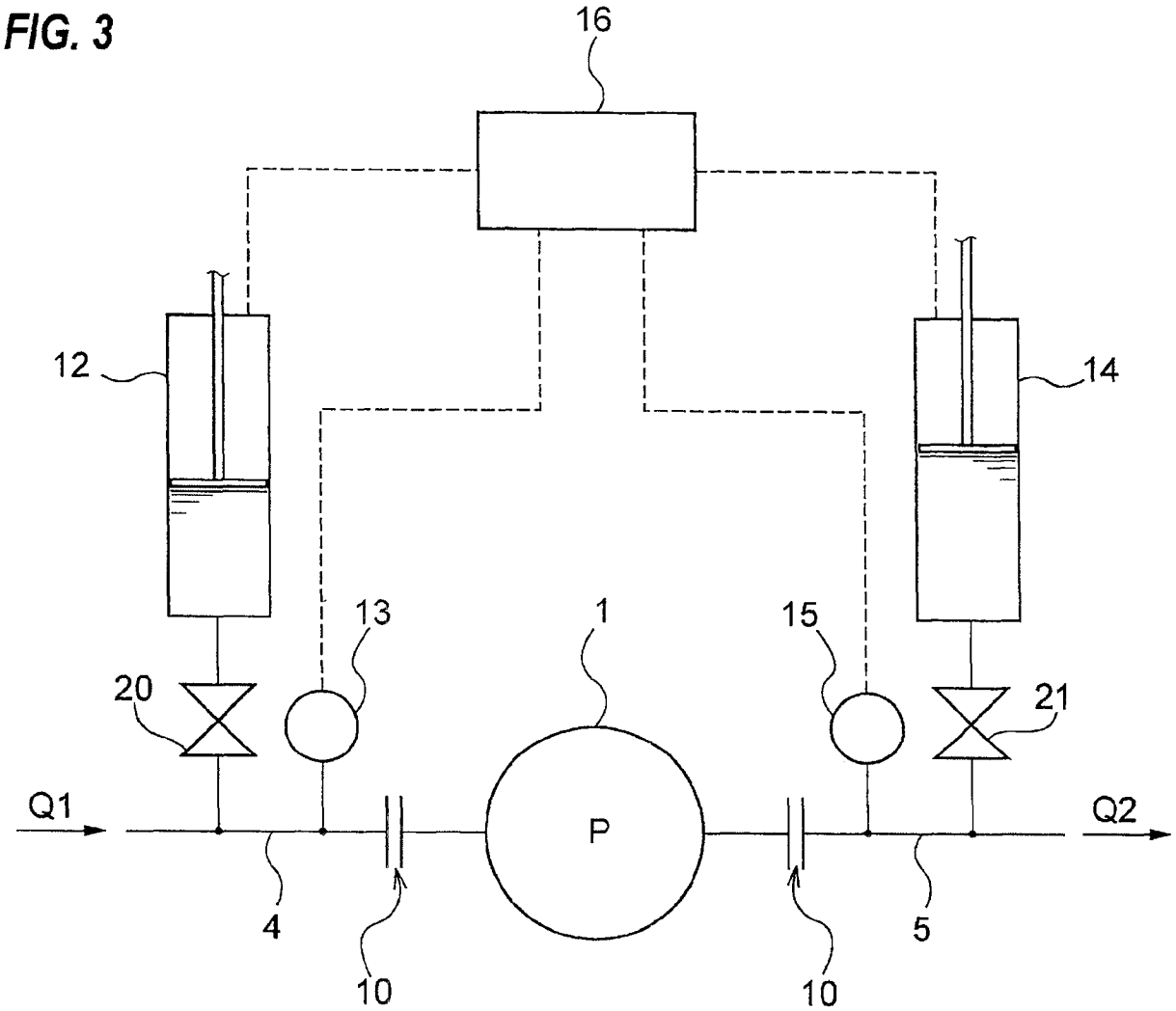
FIG. 3 is a view for illustrating an embodiment of the present invention.

FIG. 3 shows a specific embodiment of the invention that has been made in view of the above-discussed consideration. Specifically, the embodiment is directed to a method of damping the vibration by adding devices, which serve as "spring element" and "resistance element" (or damper), to the pump water-delivery system. These devices are disposed respectively on the pump upstream side and the pump downstream side, since there is a difference in flow rate between the pump upstream side and the pump downstream side due to the characteristics of the cavitation.

In FIG. 3, an upstream-side pressure detector or flow-rate detector 13 and an upstream-side pressure-increasing-and-reducing device 12 are coupled to the pump upstream side 29 which is located upstream of the pump 1. These devices are coupled to the pump suction section 27, or may be coupled to the pump-upstream pipe 4 so long as the devices are located as close to the pump suction section 27 as possible. In addition, a downstream-side pressure detector or flow-rate detector 15 and a downstream-side pressure-increasing-and-reducing device 14 are coupled to the pump downstream side 30 which is located downstream of the pump 1. These devices are coupled to the pump discharge section 28, or may be coupled to the pump-downstream pipe 5 so long as the devices are located as close to the pump discharge section 28 as possible.

The pressure-increasing-and-reducing device serves as a damping device for a pressure pulsation. Specifically, the pressure-increasing-and-reducing device may be a piston driven by an actuator, as shown in the figure, but is not limited to this embodiment. In this system, there is no bypass system, such as a bypass pipe, for returning the liquid from downstream to upstream, and a bypass operation cannot be performed.

The upstream-side or downstream-side pressure detectors or the flow-rate detectors 13, 15 detect a cyclical pressure fluctuation or a cyclical flow-rate fluctuation, and send detection information to a controller 16. Based on the information obtained from the devices, the controller 16 instructs the upstream-side and downstream-side pressure-increasing-and-reducing devices 12, 14 to increase and reduce the pressure of the liquid repeatedly in response to the cyclical pressure fluctuation phenomenon. Specifically, the devices 12, 14 increase and reduce the pressure of the liquid repeatedly at timings as to reduce the fluctuation.

In this manner, the upstream-side pressure-increasing-and-reducing device is operated in response to the fluctuation information of the pressure or flow rate detected by the upstream-side detector, while the downstream-side pressure-increasing-and-reducing device is operated in response to the fluctuation information of the pressure or flow rate detected by the downstream-side detector. Therefore, even if the upstream fluctuation cycle and the downstream fluctuation cycle are different, the upstream side and the downstream side can be controlled independently in response to the respective fluctuation states. The cycle of increasing and reducing the pressure of the liquid at the upstream side and the cycle of increasing and reducing the pressure of the liquid at the downstream side are equal to or more than a basic cycle of the pressure fluctuation observed.

In the case of controlling the pressure-increasing-and-reducing devices based on the flow rates, the controller 16 compares the flow rate measured by the flow-rate detector 13 upstream of the pump 1 and the flow rate measured by the flow-rate detector 15 downstream of the pump 1 with each other. If the flow rate at the upstream side is lower than the flow rate at the downstream side (Q1<Q2), the controller 16 instructs the upstream-side pressure-increasing-and-reducing device 12 to perform the pressure reducing operation so that the pressure near the pump suction section 27 is reduced. This operation can increase a flow velocity of the liquid in the pump-upstream pipe 4, thereby increasing Q1. Together with this operation, the controller 16 instructs the downstream-side pressure-increasing-and-reducing device 14 to perform the pressure reducing operation so that the pressure near the pump discharge section 28 is reduced. This operation can lower a flow velocity of the liquid in the pump-downstream pipe 5, thereby reducing Q2. As a result of these operations, Q1 and Q2 come closer to each other.

In an opposite case, if the flow rate at the downstream side is lower than the flow rate at the upstream side (Q1>Q2), the controller 16 instructs the downstream-side pressure-increasing-and-reducing device 14 to perform the pressure increasing operation so that the pressure near the pump discharge section 28 is increased. This operation can increase the flow velocity of the liquid in the pump-downstream pipe 5, thereby increasing Q2. In addition, the controller 16 instructs the upstream-side pressure-increasing-and-reducing device 12 to perform the pressure increasing operation so that the pressure near the pump suction section 27 is increased. This operation can increase the flow velocity of the liquid in the pump-upstream pipe 4, thereby increasing Q2. As a result of these operations, Q1 and Q2 come closer to each other.

There are various types of flow-rate measuring devices with high and low precisions, high and low prices, and large and small sizes. In many cases, it is difficult to measure the flow rate at a site where the pump is installed. In particular, it is often difficult to measure the cavitation state and the pulsation state. Thus, in such cases, the flow rate may be estimated based on a measured flow rate depending on the performance of the flow-rate detector, and the corrected flow rate may be used. In this specification, the flow rate includes such corrected flow rate.

In the case of controlling the pressure-increasing-and-reducing devices based on the pressure, if the pressure of the liquid detected by the upstream-side detector 13 is increasing in relation to a reference pressure which has been set arbitrarily, the controller 16 instructs the upstream-side pressure-increasing-and-reducing device 12 to reduce the pressure on the upward trend. In contrast, if the pressure of the liquid detected by the upstream-side detector is decreasing, the controller 16 instructs the pressure-increasing-and-reducing device 12 to increase the pressure on the downward trend.

The downstream-side pressure-increasing-and-reducing device 14 is also operated in the same manner. Specifically, if the pressure of the liquid detected by the downstream-side detector 15 is increasing in relation to a reference pressure which has been set arbitrarily, the controller 16 instructs the pressure-increasing-and-reducing device 14 to reduce the pressure on the upward trend. In contrast, if the pressure of the liquid detected by the downstream-side detector 15 is decreasing, the controller 16 instructs the pressure-increasing-and-reducing device 14 to increase the pressure on the downward trend.

In this manner, an intelligence is imparted to the control from the sensor to the actuator, so that the active control is performed in accordance with the states of the upstream side and the downstream side, while the information of the upstream side and the downstream side are processed. Therefore, even if the pump is operated over a wide range with various flow rates, the cavitation surging can be effectively alleviated or suppressed over the entirety of the operation range of the pump. Further, because the control is performed with the consideration of the pressures and the flows upstream and downstream of the pump at the time of the occurrence of the cavitation surging, the pulsation can be more effectively alleviated or suppressed in the entirety of the pump system including the pump upstream side, the pump inlet, the pump downstream side, and the pump outlet. Moreover, the pressure-increasing-and-reducing devices, provided respectively at the upstream side and the downstream side, can independently increase and reduce the pressure in response to the cyclical fluctuation of the pressure which is compared with the arbitrarily-set reference pressure. Therefore, it is not necessary to return the flow rate of the liquid, pressurized by the pump, from the downstream side to the upstream side. As a result, the stable operation can be performed at a high efficiency.

Figure 4:
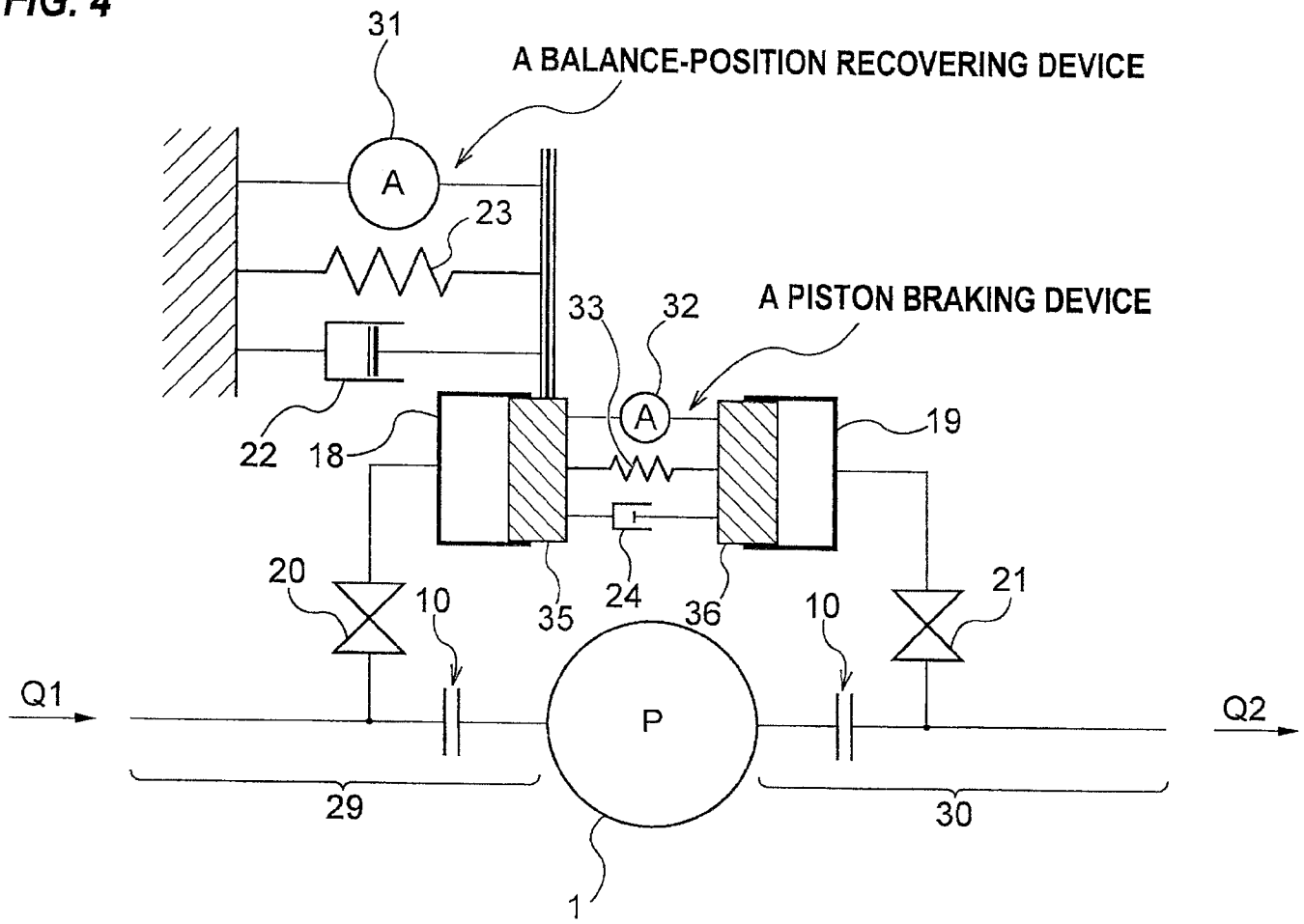
FIG. 4 is a view for illustrating another embodiment of the present invention.

FIG. 4 shows an embodiment in which two vibration suppressing devices are provided at the upstream side and the downstream side, and the situations of the upstream side and the downstream side are handled mainly by mechanical control. An upstream-side cylinder 18 and an upstream-side piston 35 are coupled to the pump upstream side 29 located upstream of the pump 1. The upstream-side piston 35 is fitted into the upstream-side cylinder 18. These devices are coupled to the pump suction section 27 of the pump upstream side 29, or may be coupled to the pump-upstream pipe 4 of the pump upstream side 29 so long as the devices are located as close to the pump suction section 27 as possible. In addition, a downstream-side cylinder 19 and a downstream-side piston 36 are coupled to the pump downstream side 30 located downstream of the pump 1. The downstream-side piston 36 is fitted into the downstream-side cylinder 19. These devices are coupled to the pump discharge section 28 of the pump downstream side 30, or may be coupled to the pump-downstream pipe 5 of the pump downstream side 30 so long as the devices are located as close to the pump discharge section 28 as possible.

The upstream-side piston 35 and the downstream-side piston 36 are coupled to each other by a device (i.e., a piston braking device) configured to stop motions of the pistons. This piston braking device is constituted by at least one of an actuator 32, a spring 33, and a dash pot 24. The actuator 32, the spring 33, and the dash pot 24 are configured such that their moduli of elasticity are adjustable. The pistons 35, 36 may have the same cross-sectional area or may have different cross-sectional areas.

When the pump upstream side is in the surging state as a result of the occurrence of the cavitation in the pump upstream side, the pressure in the pump upstream side decreases as the cavitation develops. In contrast, as the cavitation is reduced, the pressure in the pump upstream side increases. At this time, the upstream-side piston 35 is moved by the actuator 31 so as to absorb the change in the pressure. Similarly, when the pressure in the pump downstream side increases or decreases due to the cavitation surge, the downstream-side piston 36 is moved by the actuator 32 so as to absorb the change in the pressure in the pump downstream side. In this manner, the movements of the upstream-side piston 35 and the downstream-side piston 36 prevent the development of the cavitation volume Vc, so that the cavitation surge is reduced while an amplitude of the volume fluctuation is reduced in a monotonous manner or in a varying manner.

Figure 5:
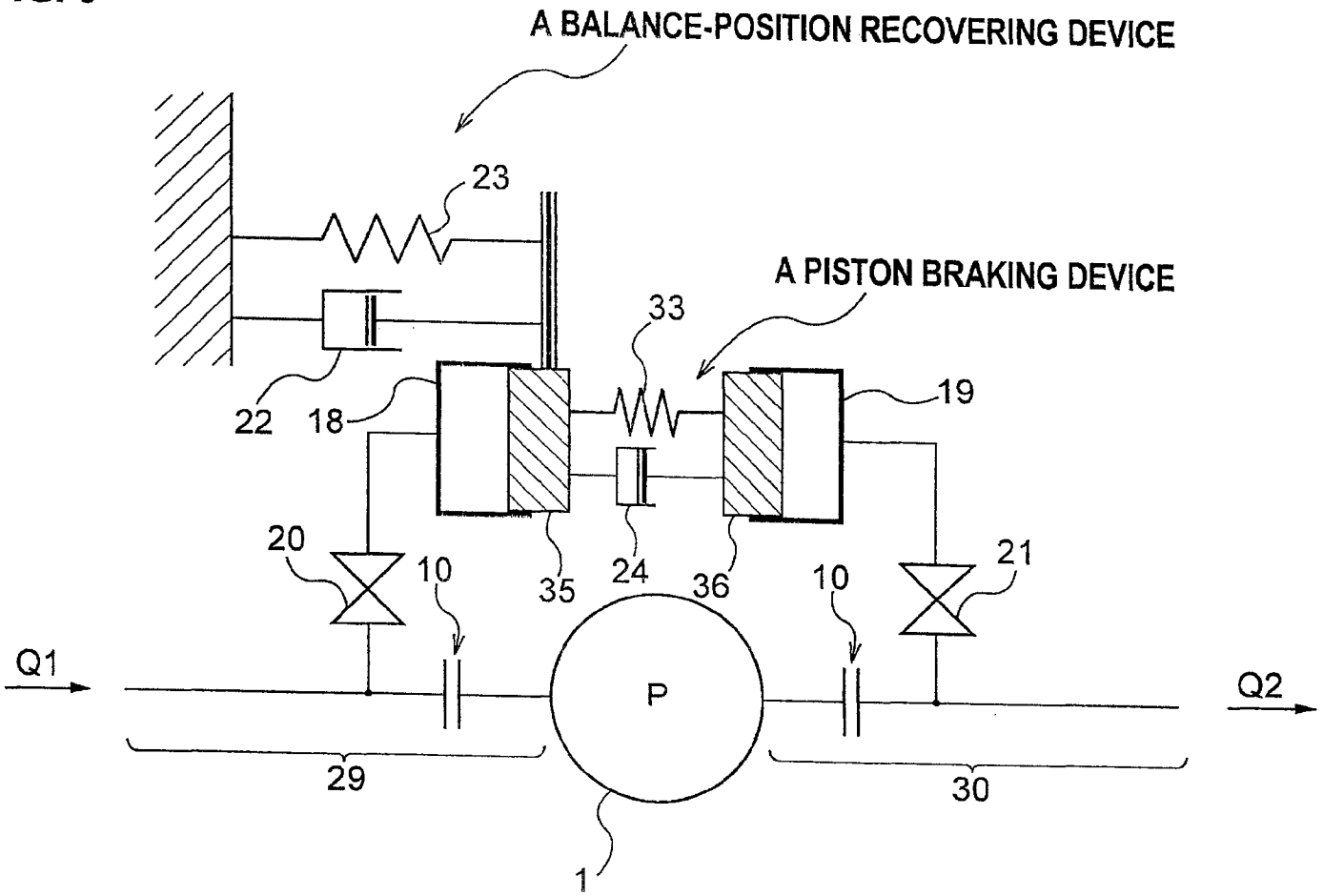
FIG. 5 is a view for illustrating still another embodiment of the present invention.

In FIG. 3 and FIG. 4, the sensors and the actuators are installed at both the upstream side and the downstream side, thus possibly causing an increase in space, an increase in complexity of the system as a whole, and an increase in the price of the apparatus. Moreover, it may be possible to sufficiently suppress the cavitation surge by only using passive devices, such as spring and damper, without using the sensors and the actuators. From this viewpoint, FIG. 5 shows another specific embodiment of the present invention without using the actuator shown in FIG. 4.

The pressure fluctuation at the upstream side and the pressure fluctuation at the downstream side may be different in: (1) the cycle; (2) the amplitude; or (3) the phase with the same cycle. In such cases, the spring 33 and the dash pot 24, both of which are coupled to the upstream-side piston 35 and the downstream-side piston 36, are adjusted so that operation cycles, amplitudes, and phases of the piston 35 and the piston 36 become appropriate.

A balance position of the pistons 35, 36 is preferably a middle position of a stroke of each of the cylinders 18, 19 when no cavitation surge occurs. However, a condition for obtaining a balance between a force determined by the product of the upstream pressure in a steady state and the cross-sectional area of the cylinder and a force determined by the product of the downstream pressure and the cross-sectional area of the cylinder does not necessarily agree with the product of the cross-sectional area of the cylinder and the piston stroke required for increasing and reducing the upstream pressure and a condition of the product of the cross-sectional area of the cylinder and the piston stroke required for increasing and reducing the downstream pressure.

In FIG. 4, "a balance-position recovering device" is necessary for at least one of the piston 35 and the piston 36. The balance-position recovering device is constituted by at least one of the spring 23, the dash pot 22, and the actuator 31, each of which is coupled to an external fixed point. The balance position of the pistons 35, 36 is determined by the adjustment of the spring 23, the dash pot 22, the actuator 31, and the like.

Valves 20, 21 in fluid passages are provided for regulating the flow rates of the liquid flowing into the pistons 35, 36. The regulation valves 20, 21, which are provided in the fluid passages coupled to the pump upstream side and the pump downstream side, may be used to alleviate the difference in flow rate between the pump upstream side and the pump downstream side and to alleviate the fluctuation of the flow rates in the pump upstream side and the pump downstream side.

Figure 6:
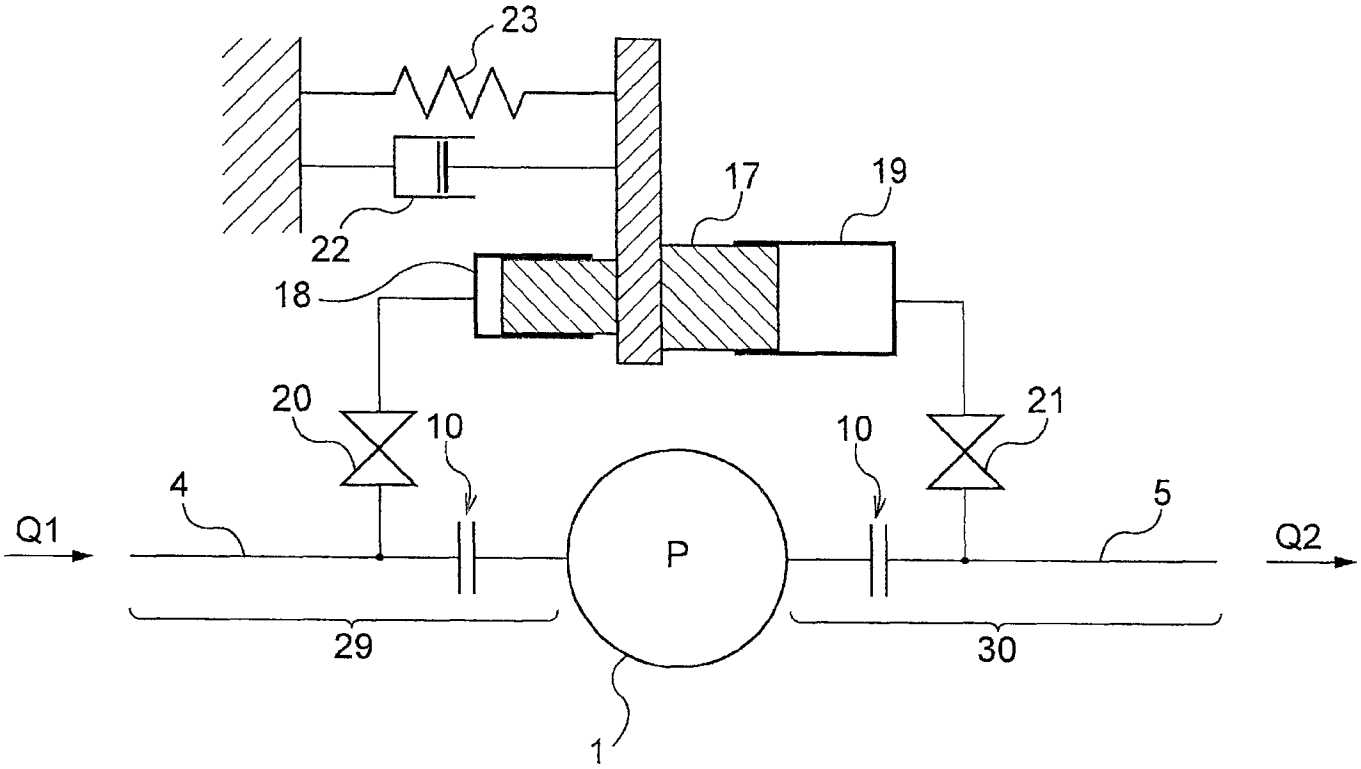
FIG. 6 is a view for illustrating still another embodiment of the present invention.

FIG. 6 shows another specific embodiment of the present invention with a compact size. There are cases where the vibration of the system can be stopped only by changing a current value of the constant of "spring element", "inertia element", or "resistance element" of the pipe system including the pump. In such cases, it is not necessary to provide the adjustment devices, such as the spring 33 and the dash pot 24, which couple the upstream-side piston 35 to the downstream-side piston 36 in FIG. 5. Basically, this embodiment comprises an upstream-side cylinder 18 coupled to the pump-upstream pipe 4 of the pump upstream side 29, a downstream-side cylinder 19 coupled to the downstream-side pipe 5 of the pump downstream side 30, and a piston 17 fitted into both the cylinders. The piston 17 may have a cross-sectional area(s) corresponding to the same or different cross-sectional area(s) of the cylinders 18, 19. The piston 17 can cyclically apply a suitable pressure to the upstream side and the downstream side alternately. The pressure applied by the piston 17 can be adjusted only by the cross-sectional areas of the upstream-side cylinder and the downstream-side cylinder. This configuration can achieve the same effect as discussed previously with a smaller space.

In FIG. 6, the spring 23, the dash pot 22, and the like are configured to be adjustable, and are adjusted for the balance position of the piston 17.

Next, an embodiment of the present invention for suppressing the cavitation surge from a different viewpoint than the above embodiments will be described.

There is the following relation between a frequency f of the cavitation surge and the cavitation compliance κ.

$$f \propto 1/\kappa^{\alpha} \text{ (}\alpha\text{represents a positive constant)}$$

Further, there is the following relation between the cavitation compliance κ and the cavitation volume Vc.

$$\kappa \propto Vc$$

Therefore, the larger the cavitation volume Vc is, the larger the cavitation compliance κ becomes. In addition, the larger the cavitation volume Vc is, the smaller the frequency of the cavitation surge becomes. The smaller the frequency becomes, the less the cavitation surge is likely to occur.

In view of this, in order to make the cavitation compliance κ large, the inventor has conceived of a dummy volume which is generated near a location where the cavitation occurs in the pump. This dummy volume behaves as if the cavitation volume increases, in addition to the actual cavitation volume Vc, at the same time as the actual cavitation occurs.

Figure 7:
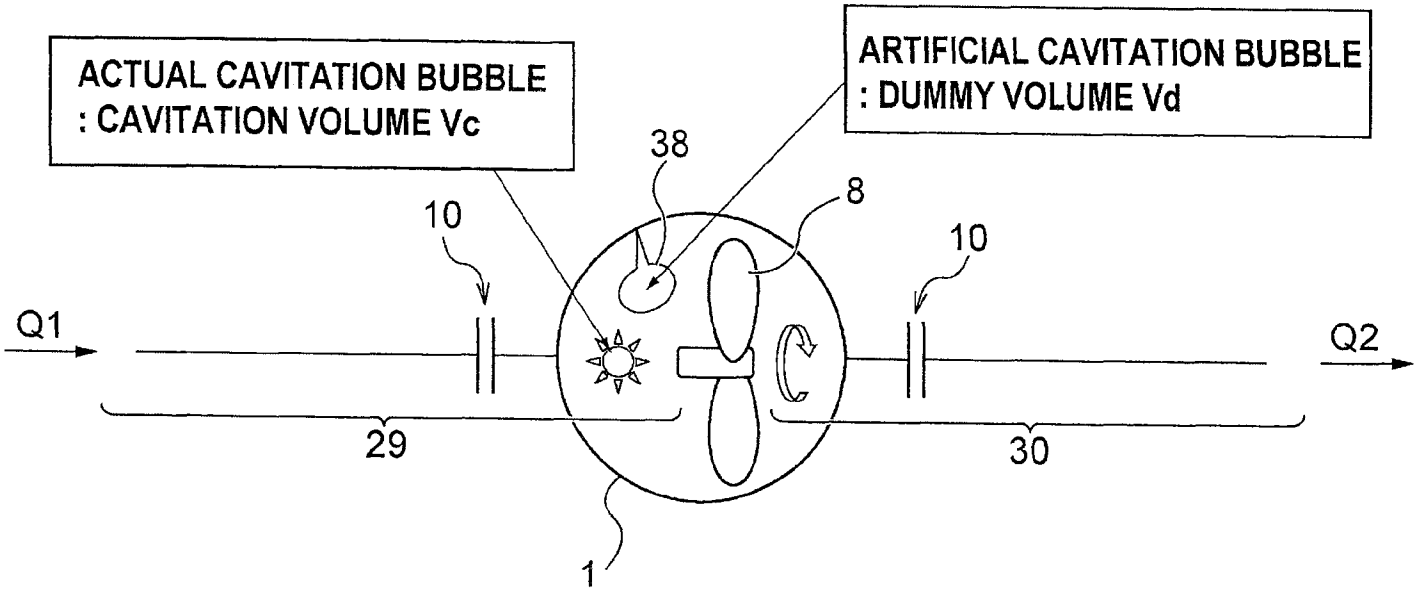
FIG. 7 is a view for illustrating still another embodiment of the present invention.

FIG. 7 shows an embodiment. Specifically, there is provided a gas bag (like a rubber balloon) 38 in which a small amount of gas is enclosed. This gas bag swells in the pump suction section (or in the pump-upstream pipe near the pump suction section) of the turbo pump. When the cavitation surge does not occur, the gas is removed from the gas bag 38. The gas bag 38 is arranged in a folded state on an inner wall of the pump casing. When the cavitation surge occurs, the gas bag 38 is caused to swell. During the surging, the gas bag 38 expands and contracts. This volume of the gas bag 38 that is expanding and contracting is the dummy volume.

The dummy volume, which is defined as Vd, can be regarded as an artificial cavitation volume. The cavitation compliance κ can be regarded as a combination of the actual cavitation volume Vc and the dummy volume Vd, which is expressed as $$\kappa \propto (Vc+Vd)$$

Therefore, the value of the cavitation compliance κ can be increased substantially. As a result, the frequency f of the cavitation surge can be reduced. In other words, the dummy volume can lower the amplitude of the cavitation surge, and can rapidly alleviate the cavitation surge toward the settlement.

Figure 8:
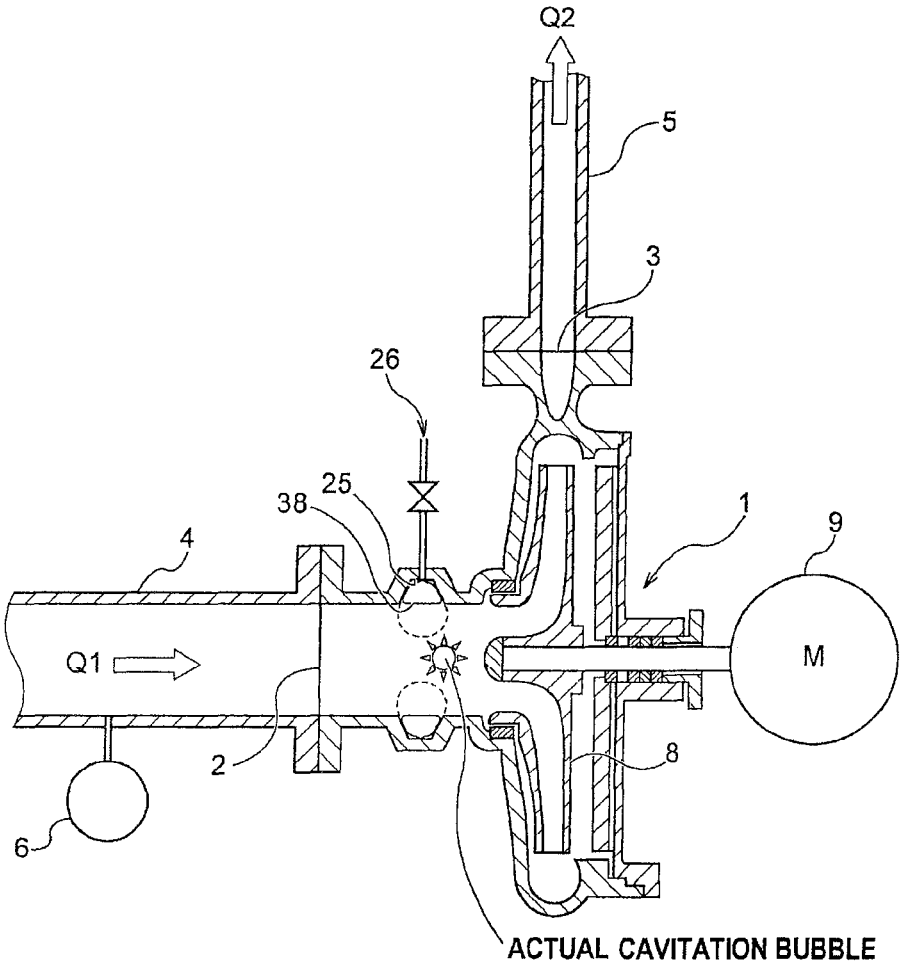
FIG. 8 is a view for illustrating still another embodiment of the present invention.

FIG. 8 shows a further detailed embodiment. The bag 38 is disposed in a bag storage groove 25, which is in an annular shape and is located in the upstream-side casing of the pump 1. The bag storage groove 25 preferably has a tapered shape that is open toward the center of the annular shape.

Before the cavitation occurs, the bag 38 (indicated by solid line) is housed in the groove 25. A gas may be enclosed in the bag 38 in advance. The upstream external device 6, which is the pressure detector or flow-rate detector, may be mounted to the pump-upstream pipe 4 so that the gas is supplied from a gas supply inlet 26 upon receiving the information indicating the decrease in the pressure or flow rate. When the cavitation occurs, the bag 38 swells (or is forced to swell) as indicated by dotted line. The combination of the cavitation volume Vc and the increased volume of the bag 38 can lower the frequency f of the cavitation surge. An operator may manually swell and house the bag 38 from outside the pump.

Figure 9:
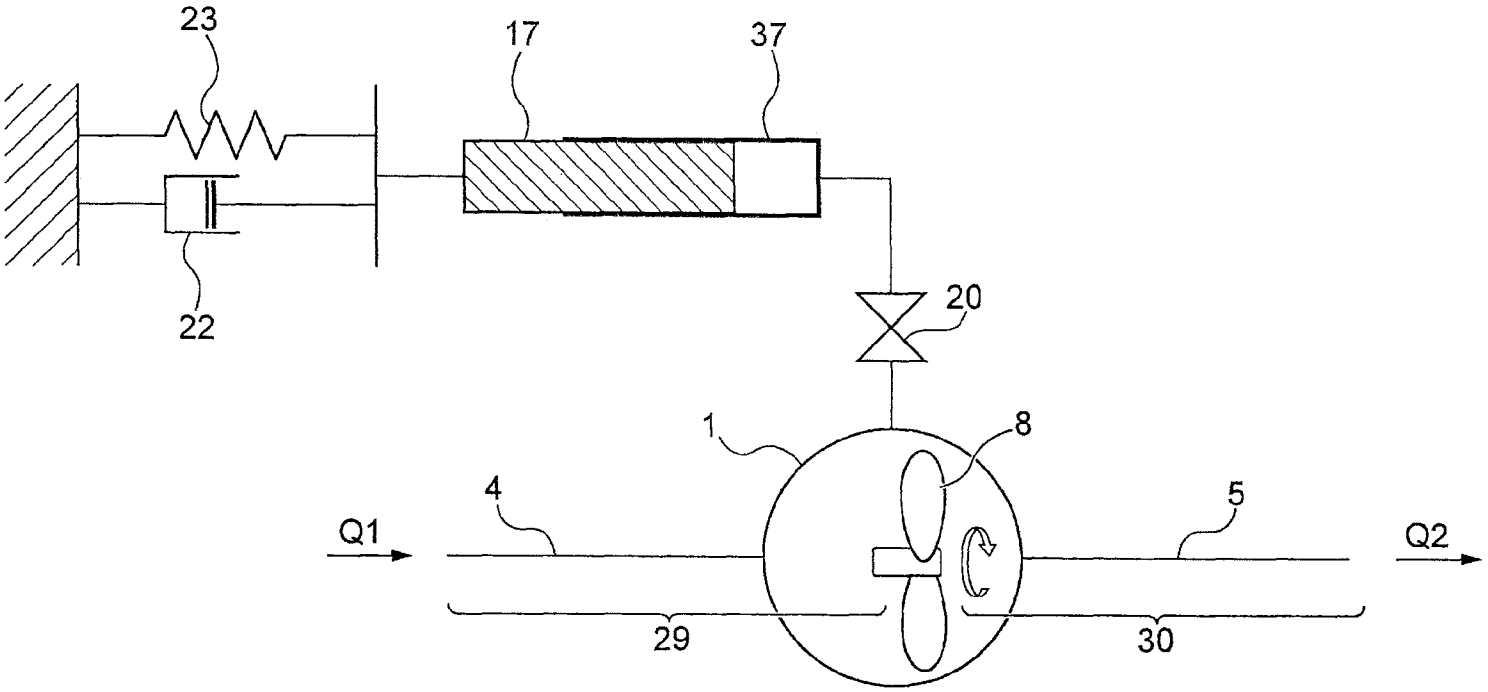
FIG. 9 is a view for illustrating still another embodiment of the present invention.

FIG. 9 is shows a method and an apparatus which can achieve the same effect as that of the embodiment shown in FIG. 8, without using the gas bag. Specifically, an accumulator containing a gas therein or a system including a spring, a mass, and a dash pot is directly mounted to the pump casing.

In FIG. 9, the cylinder 37 is coupled to the upstream-side casing of the pump 1 or the pump-upstream pipe 4. The piston 17 is fitted into the cylinder 37. The spring 23 and the dash pot 22 are coupled to the piston 17. In FIG. 9, the spring 23 corresponds to the bag 38 of FIG. 8. When the cavitation occurs, the pressure in the pump upstream side is lowered. As a result, the spring 23 expands so that the product of the expansion of the spring 23 and the cross-sectional area of the piston 17 becomes equal to the volume Vd of the expanded bag of FIG. 8. Since this configuration is stiffer than the gas bag, a long life can be expected.

As discussed above, the cavitation is grasped as the vibration phenomenon, and the method and apparatus for suppressing the cavitation surge have been described from two different viewpoints. It is possible to use these two viewpoints separately, or to use a combination thereof. The use of such a combination is effective in a wide operation range of the pump, and can maintain a stable flow with less fluctuation of the flow rate in both the pump upstream side and the pump downstream side. Further, the frequency of the surge can be lowered at a first stage of the occurrence of the cavitation surge, and as a result, a stable operation can be achieved.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable not only to the embodiments shown in FIG. 1 and FIG. 7, but also to the prevention of the cavitation surge in a turbo pump for delivering a liquid.

REFERENCE SIGNS LIST

1 pump
4 pump-upstream side
5 pump-downstream side
10 flange
12 upstream-side pressure-increasing-and-reducing device
13 upstream-side pressure or flow-rate detector
14 downstream-side pressure-increasing-and-reducing device
15 downstream-side pressure or flow-rate detector
16 controller

The invention claimed is:

1. An apparatus for suppressing a cavitation of a turbo pump, comprising:

a turbo pump for delivering a liquid;

a first damping device configured to repeatedly increase and reduce a pressure of the liquid upstream of the turbo pump so as to damp an amplitude of a cyclical pressure fluctuation of the liquid upstream of the turbo pump; and a second damping device configured to repeatedly increase and reduce a pressure of the liquid downstream of the turbo pump so as to damp an amplitude of a cyclical pressure fluctuation of the liquid downstream of the turbo pump, the first damping device and the second damping device being operable independently of each other, wherein the liquid downstream of the turbo pump is not returned to an upstream side of the turbo pump, wherein each of the first damping device and the second damping device comprises a piston and a cylinder, and wherein the apparatus further comprises a piston braking device configured to stop motions of the piston of the first damping device and the piston of the second damping device, and further comprises a balance-position recovering device configured to recover a balance position of at least one of the piston of the first damping device and the piston of the second damping device.

2. The apparatus for suppressing a cavitation of a turbo pump according to claim 1, wherein:

the first damping device is configured to perform a pressure-reducing operation when the pressure of the upstream liquid increases and to perform a pressure-increasing operation when the pressure of the upstream liquid decreases; and the second damping device is configured to perform a pressure-reducing operation when the pressure of the downstream liquid increases and to perform a pressure-increasing operation when the pressure of the downstream liquid decreases.

3. The apparatus for suppressing a cavitation of a turbo pump according to claim 1, further comprising a controller configured to instruct the first damping device and the second damping device to perform operations based on information obtained from a detector provided upstream of the turbo pump and information obtained from a detector provided downstream of the turbo pump.

4. The apparatus for suppressing a cavitation of a turbo pump according to claim 1, wherein:

the piston braking device comprises at least a spring and a dashpot; and the balance-position recovering device comprises at least a spring and a dashpot.

* * * * *